US009011304B2

(12) United States Patent
Gilman

(10) Patent No.: US 9,011,304 B2
(45) Date of Patent: Apr. 21, 2015

(54) FUNCTIONAL POWER GRIP

(71) Applicant: Neil F. Gilman, South Glastonbury, CT (US)

(72) Inventor: Neil F. Gilman, South Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 209 days.

(21) Appl. No.: 13/716,043

(22) Filed: Dec. 14, 2012

(65) Prior Publication Data

US 2013/0157823 A1 Jun. 20, 2013

Related U.S. Application Data

(60) Provisional application No. 61/570,437, filed on Dec. 14, 2011.

(51) Int. Cl.
*A63B 21/00* (2006.01)

(52) U.S. Cl.
CPC ..... *A63B 21/00* (2013.01); *A63B 21/1469* (2013.01); *A63B 21/1484* (2013.01)

(58) Field of Classification Search
CPC ..... A63B 21/1469; A63B 21/0552; A63B 21/0557
USPC ..... 482/139, 44–50, 92, 148; 403/109.6, 403/161, 2, 224, 78, 379.1, 305, 306, 308
See application file for complete search history.

(56) References Cited

U.S. PATENT DOCUMENTS

| | | | | |
|---|---|---|---|---|
| 4,540,173 | A * | 9/1985 | Hopkins, Jr. | 482/124 |
| 4,756,527 | A * | 7/1988 | Ledbetter | 482/139 |
| 4,909,505 | A * | 3/1990 | Tee | 482/129 |
| 4,955,750 | A * | 9/1990 | Goran | 403/306 |
| 5,090,691 | A * | 2/1992 | Pollock | 482/139 |
| 5,518,486 | A * | 5/1996 | Sheeler | 482/131 |
| 5,857,949 | A * | 1/1999 | Tebbe et al. | 482/140 |
| 5,921,903 | A * | 7/1999 | Lawrence | 482/140 |
| 6,551,222 | B1 * | 4/2003 | Beaver | 482/82 |
| 6,606,769 | B1 * | 8/2003 | Harris | 24/599.2 |
| 6,692,415 | B1 * | 2/2004 | Winston | 482/126 |
| 6,860,841 | B1 * | 3/2005 | Mortorano | 482/126 |
| 7,473,213 | B1 * | 1/2009 | Kallenbach | 482/139 |
| 7,691,040 | B1 * | 4/2010 | Schwinghamer | 482/139 |
| 7,749,140 | B1 * | 7/2010 | Lindemeier et al. | 482/82 |
| 7,806,814 | B2 * | 10/2010 | Hetrick | 482/139 |
| 8,162,808 | B2 * | 4/2012 | Cook | 482/112 |
| 2002/0103059 | A1 * | 8/2002 | Kushner | 482/126 |
| 2004/0009858 | A1 * | 1/2004 | Tamaribuchi | 482/139 |
| 2005/0059537 | A1 * | 3/2005 | Hull | 482/124 |
| 2005/0085350 | A1 * | 4/2005 | Shen | 482/91 |
| 2005/0192169 | A1 * | 9/2005 | Girgen et al. | 482/139 |
| 2005/0227833 | A1 * | 10/2005 | Wilkinson | 482/124 |
| 2008/0261788 | A1 * | 10/2008 | Blount | 482/139 |
| 2009/0215595 | A1 * | 8/2009 | Alessandri et al. | 482/139 |
| 2011/0130257 | A1 * | 6/2011 | Hartman et al. | 482/139 |
| 2011/0166003 | A1 * | 7/2011 | Brice et al. | 482/131 |

* cited by examiner

*Primary Examiner* — Loan H Thanh
*Assistant Examiner* — Andrew S Lo
(74) *Attorney, Agent, or Firm* — Day Pitney LLP

(57) ABSTRACT

The disclosure includes a variety of functional power grips. An exemplary grip includes a generally elongate handle portion having a gripping surface for a user, and a generally flexible member having a first end and a second end, the generally flexible member having a cross sectional dimension that is substantially the same as the handle portion, wherein the first and second ends of the generally flexible member are attached to first and second ends of the handle portion, the handle portion and generally flexible member cooperating to form a loop, and a strap disposed about the generally flexible member for attaching the functional power grip to a piece of exercise equipment.

8 Claims, 5 Drawing Sheets

FUNCTIONAL POWER GRIP

CROSS-REFERENCE TO RELATED APPLICATION

The present application claims the benefit of priority to U.S. Provisional Application No. 61/570,437, filed Dec. 14, 2011. The aforementioned patent application is incorporated by reference herein in its entirety for any purpose whatsoever.

BACKGROUND

1. Field of the Disclosure

The present disclosure relates to methods, systems and articles for strength training. Particularly, the present disclosure is directed to grip designs for exercising.

2. Description of Related Art

A variety of grips are known for strength training and the like. For example, grip bars of various configurations are known for cable resistance machines, such as for performing back strengthening work ("lat pull downs"), for increasing chest muscle strength in e.g., cable cross over weight training systems, and the like. Other pulling movements can be performed such as seated rows as well as leg strengthening work via cable mechanisms, such as by using ankle straps attached to the cable mechanisms, and the like. The present disclosure provides a unique grip that Applicant believes provides advantages over the art.

SUMMARY OF THE DISCLOSURE

Advantages of the present disclosure will be set forth in and become apparent from the description that follows. Additional advantages of the disclosure will be realized and attained by the methods and systems particularly pointed out in the written description and claims hereof, as well as from the appended drawings.

To achieve these and other advantages and in accordance with the purpose of the disclosure, as embodied herein, the disclosure includes a variety of functional power grips. An exemplary grip includes a generally elongate handle portion having a gripping surface for a user, and a generally flexible member having a first end and a second end, the generally flexible member having a cross sectional dimension that is substantially the same as the handle portion, wherein the first and second ends of the generally flexible member are attached to first and second ends of the handle portion, the handle portion and generally flexible member cooperating to form a loop, and a coupler disposed about the generally flexible member for attaching the functional power grip to a piece of exercise equipment.

In accordance with further aspects, the functional power grip may further include a pair of crimps, each crimp being swaged to one of the first and second ends of the generally flexible member. The crimps can be fitted into and attached to the generally elongate handle portion. The generally flexible member can be, for example a rope or a cable. The generally elongate handle portion can be a tubular member. The crimps can be press-fit into the handle portion, or the crimps can be attached to the handle portion by a coupling that passes through the handle, the crimps and the generally flexible member. The handle can include a generally tubular member having a flange at each end. The coupler can include, for example, a webbing that forms a first loop about the generally flexible member and a second loop that is formed over a metallic ring.

It is to be understood that the foregoing general description and the following detailed description are exemplary and are intended to provide further explanation of the disclosed embodiments.

The accompanying drawings, which are incorporated in and constitute part of this specification, are included to illustrate and provide a further understanding of the method and system of the disclosed embodiments. Together with the description, the drawings serve to explain principles of the disclosed embodiments.

DETAILED DESCRIPTION OF PREFERRED EMBODIMENTS

Reference will now be made in detail to the present preferred embodiments of the disclosure, examples of which are illustrated in the accompanying drawings.

The functional power grip devices presented herein may be used as an alternative to existing grips and grip attachments for performing a variety of exercises, such as "lat pull downs" seated rows, tricep extensions, curls, presses, and the like. The disclosed embodiments are particularly suited for providing an enhanced surface for gripping as compared with known devices.

Thus, in accordance with the disclosure, a functional power grip device is provided including a handle, a rope subassembly, and if desired a strap and "D" ring or other suitable hardware.

Figure 1:
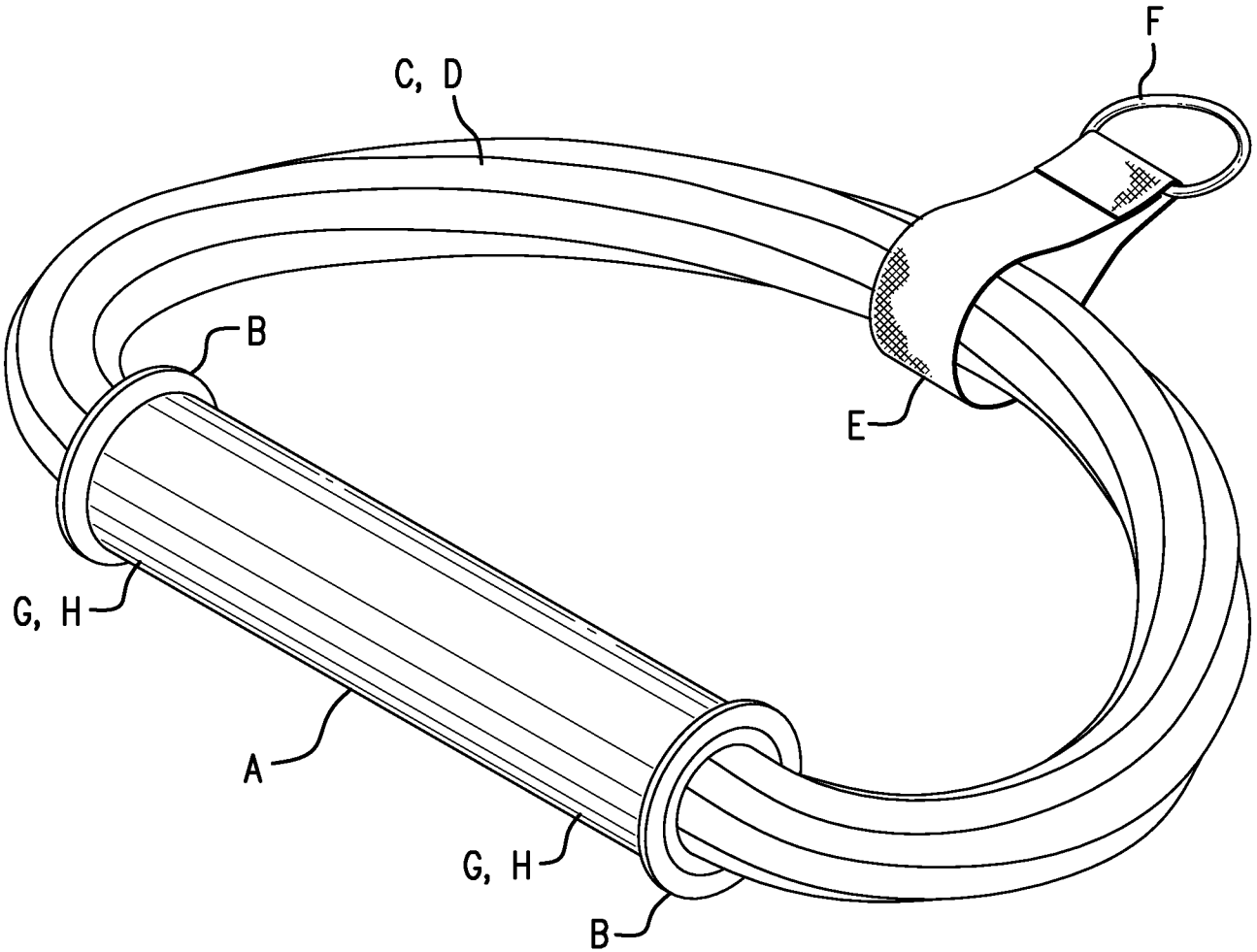
FIG. 1 is an isometric view of a first representative embodiment of a functional power grip device in accordance with the disclosure.

For purpose of explanation and illustration, and not limitation, a view of an illustrative functional power grip device in accordance with the disclosure is shown in FIG. 1. Alternative views of the power grip device, or components thereof, are illustrated in FIGS. 2-5.

Figure 2B:
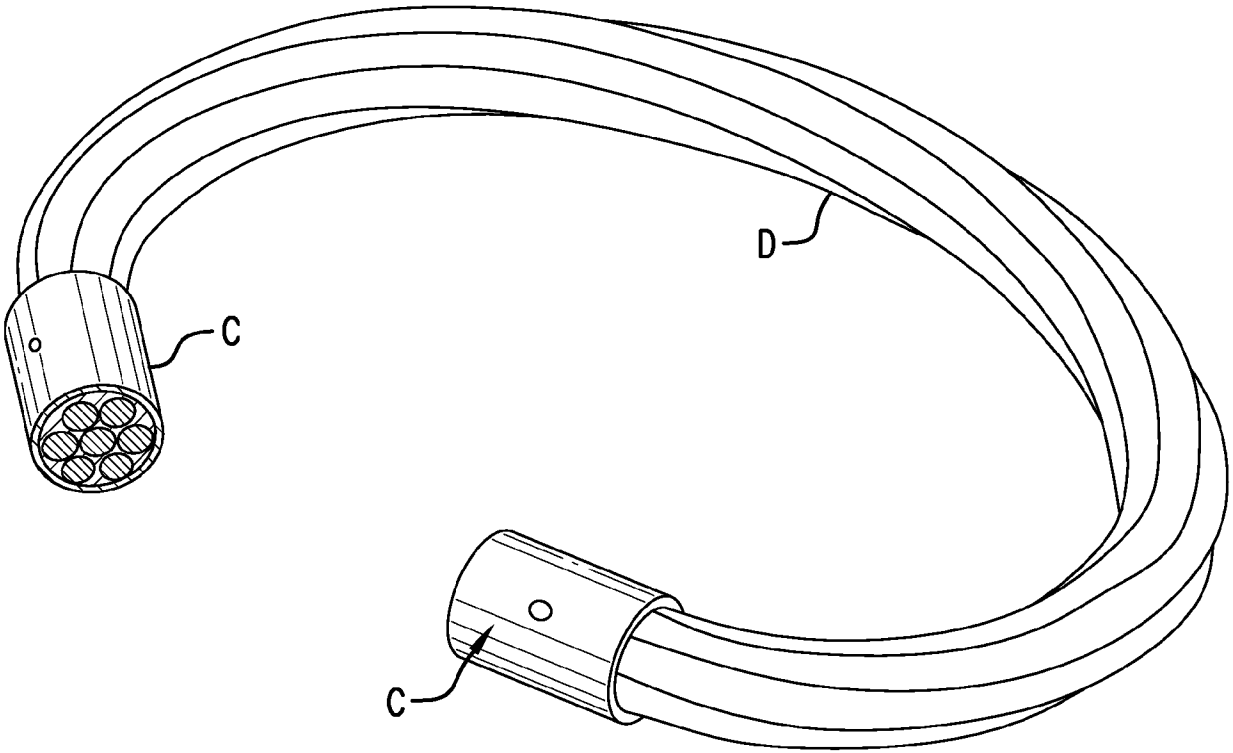
FIG. 2B is an isometric view of a rope subassembly of the functional power grip of FIG. 1.

As illustrated in FIGS. 1 and 2, the functional power grip includes a generally tubular handle A that is attached to a rope subassembly. The rope subassembly is specifically illustrated in FIG. 2B and includes a rope D having a crimp sleeve C swaged onto each end. As further illustrated in FIG. 1, handle A includes flared ends B that can be formed in a variety of ways. For example, flared ends B may be milled rings that are press-fit and/or welded or otherwise attached to handle A. As illustrated, the surface of handle A can be knurled or otherwise patterned to form a suitable gripping surface. Alternatively, if desired, flared ends B may be molded from one or more polymers and press fit onto handle A. In an alternative embodiment, the handle can be formed by overmolding a rubberized grip onto tubular metallic material with any desired grip pattern.

Figure 2A:
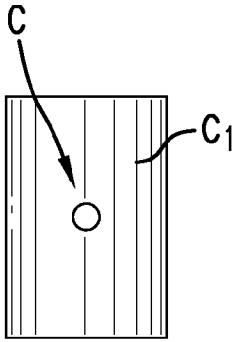
FIG. 2A is a plane view of a crimp for swaging onto an end of a rope or flexible member of the functional power grip of FIG. 1.

With reference to FIG. 2, a crimp C is illustrated in FIG. 2A that includes a generally tubular metallic member, such as of steel, having a lengthwise slit C1. Crimp is swaged around the end of rope D (e.g., in a hydraulic press inside a generally circular die having a diameter smaller than the crimp C prior to installation) in order to hold the end of the rope D firmly within the crimp C. The crimp C may be predrilled with a hole or a hole may be drilled through the crimp and the rope after crimping to provide passage for coupler (including screws G and internally threaded tube H) therethrough. As illustrated, flat-head machine screws are countersunk into the surface of the handle A. Alternatively, the swaged end of the rope subassembly C, D may be inserted into the end of the handle and then a hole may be drilled through all of the components to ensure adequate alignment to permit the passage of coupler G, H therethrough. Strap E and D-ring F can be passed over rope D prior to assembly of all the components. Strap E generally includes webbing that is stitched into two loops—one to permit passage of rope therethrough and one to permit passage of D-ring therethrough. As illustrated, an overlap exists in the webbing between these two loops that can be stitched along multiple directions with sturdy (e.g., nylon or Dacron) thread of suitable denier.

Figure 3A:
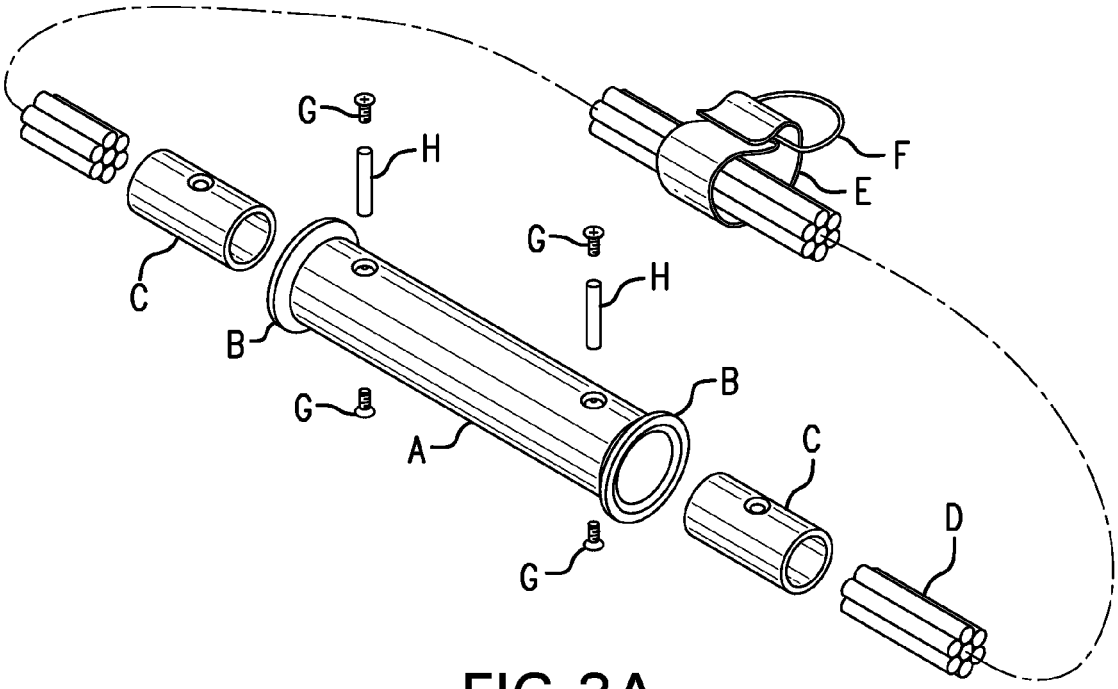
FIG. 3A is an isometric exploded view of the functional power grip device of FIG. 1 with only portions of the rope subassembly being visible.
Figure 3B:
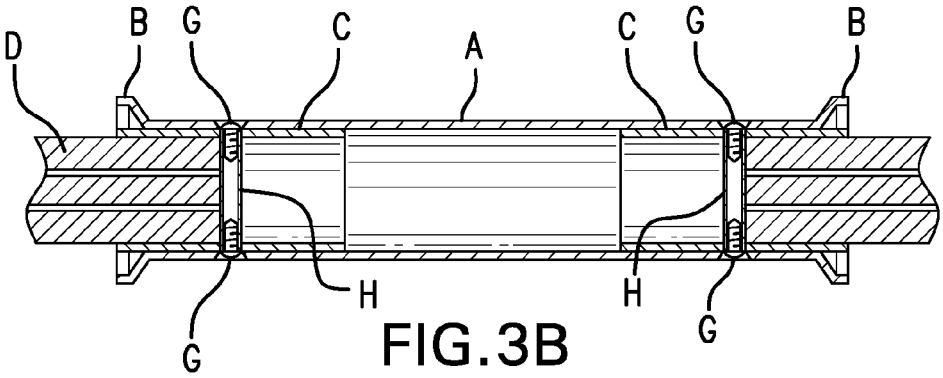
FIG. 3B is a cross section through the handle of the illustrative functional power grip of FIG. 1 showing the arrangement of assembled components.

FIG. 3A illustrates an exploded component view of the power grip device, wherein the rope D is only partially shown, but generally traces an arcuate loop that follows the curved lead line that joins the illustrated portions of the rope D. Clearly visible are rope D, handle A, flanges B, couplers G, H, crimp sleeves C and strap E with D-ring F. FIG. 3B illustrates a lengthwise cross-section through the handle of the assembled power grip device showing the relative arrangement of the rope D, crimps C, handle A, flanges B and couplers G, H.

Figure 4B:
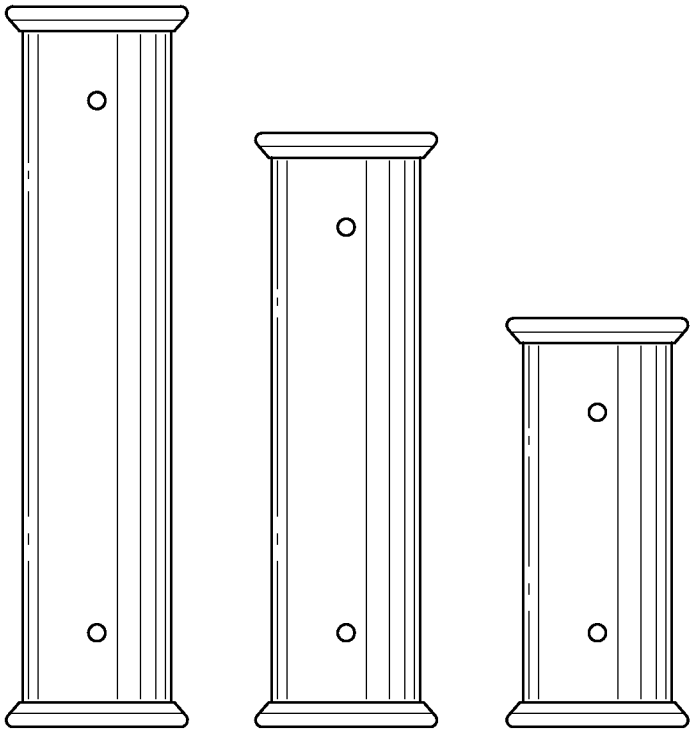
FIGS. 4A-4B illustrate various embodiments of handle components of the disclosed functional power grip device.
Figure 4A:
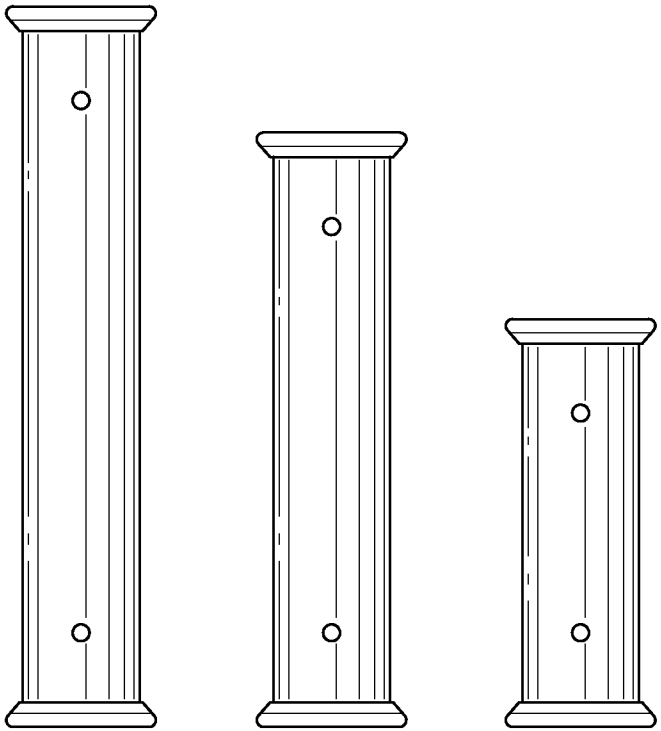
Figure 5B:
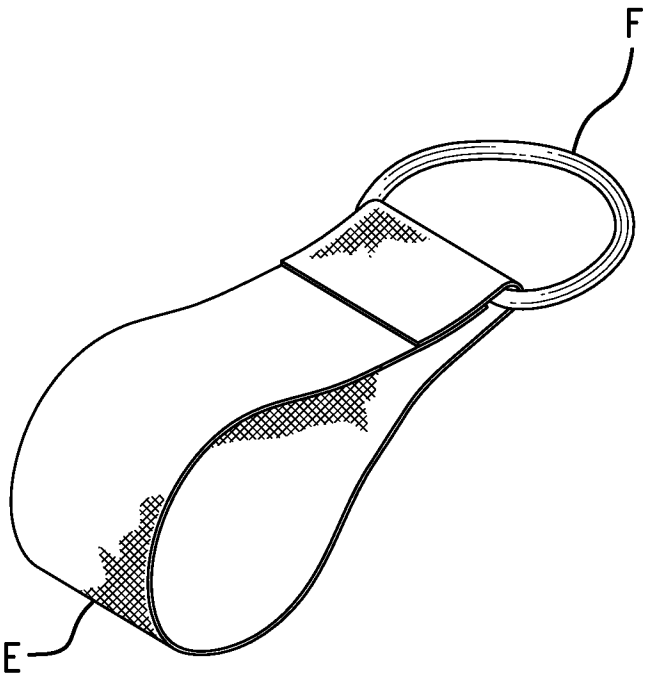
FIG. 5B illustrates an exemplary strap and "D" ring for placement over the rope subassembly of the functional power grip of FIG. 1.
Figure 5A:
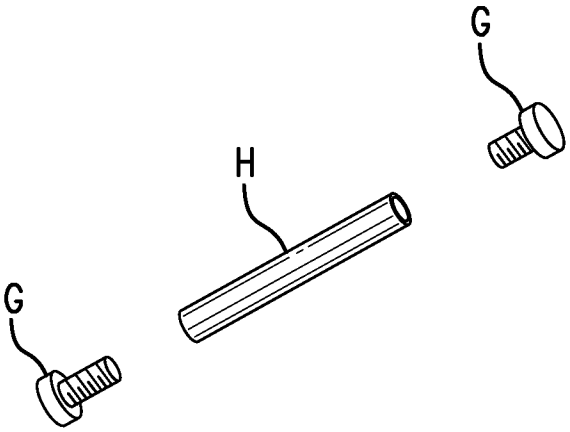
FIG. 5A illustrates a connection bolt that is directed through one end of the handle and through the crimp and rope of the rope subassembly to hold the functional power grip device together.

FIGS. 4A-4B illustrate various embodiments of handles A with flanges B that can be used for the disclosed functional power grip device. As will be appreciated, the length of the handle can be varied, as well as its diameter, to accommodate ropes D of varying diameter. For purposes of illustration only, rope can have a general diameter of about 0.5 inches, about 0.75 inches, about 1.0 inches, about 1.25 inches, about 1.5 inches, about 1.75 inches, about 2.0 inches, about 2.25 inches, about 2.50 inches, about 2.75 inches or about 3.0 inches, among others. The relative diameters of the handle A with flanges B and crimps C and strap E can be varied accordingly to accommodate ropes of different diameters, and vice-versa.

It will be appreciated that a variety of materials can be used to form the components of the illustrated functional power grip. In some embodiments, various aluminum alloys can be used for the handle A, flanges B and crimp sleeves C. However, it will be appreciated that other materials can be used, such as various steel alloys, copper, magnesium, brass, zinc and the like. Moreover, as alluded to above, the handle and flange assembly can be formed from overmolding a metallic tube. Alternatively, handle A with flanges B could be formed from an injection molded material, or a fiber reinforced composite material, as desired. Rope D can be formed from a variety of materials such as polyester (e.g., Dacron®) material, metallic materials, nylon or other polymers, as well as hemp or other plant fiber, among other materials. Strap E can be, for example, woven webbing material formed from natural or synthetic materials, such as heavy duty polypropylene, aramid fibers (e.g., Kevlar), nylon material and the like. The D ring can be formed from any suitable material, and is preferably formed from nickel plated steel or similar material. The coupler can be formed from machine screws G and an internally threaded coupler, formed for example from aluminum, steel or brass, as desired.

The disclosed embodiments of the functional power grip device can be used in conjunction, for example, with any suitable exercise equipment by attaching the D ring to a cable of a weight training device, such as via a clip or other removable coupling, and then gripping the handle A in order to perform resistance training. Advantageously, flanges B act to prevent the user's hands from slipping off of the handle along its length. If desired, a user may also grip the rope portion with both hands on either side of the strap E, and use the rope as a grip. This can be useful for developing grip strength, particularly if the rope is smoother than the handle A, as more gripping force will need to be exerted in order to maintain a grip on the functional power grip.

In some embodiments, generally large diameter handles (and ropes) are used to provide a larger gripping surface area than previous devices. This can be referred to herein as a "fat grip" or an enhanced grip. For example, handle can be about two inches in diameter for an average man, or about 1.5 inches in diameter for an average woman. The handle portion A is ideally large enough in diameter so that the ends of the user's fingers can just barely touch their thumb when they are gripping the functional power grip. This enlarged grip helps spread out the stress from the weight that is being lifted, for example, permitting users to challenge themselves with ever increasing resistances. As such, a method of exercising is also disclosed using an enhanced, or "fat" grip, as embodied herein.

The methods and systems of the disclosed embodiments, as described above and shown in the drawings, provide for exercise equipment and related techniques with superior attributes including improved safety and ease of use. It will be apparent to those skilled in the art that various modifications and variations can be made in the devices and methods of the disclosed embodiments without departing from the spirit or scope of the disclosure. Thus, it is intended that the disclosed embodiments include modifications and variations that are within the scope of the appended claims and their equivalents.

What is claimed is:

1. A functional power grip, comprising:

a generally elongate handle portion having a gripping surface for a user;

a generally flexible member having a first end and a second end, the generally flexible member having a cross sectional dimension that is substantially the same as the handle portion, wherein the first end of the generally flexible member is attached to a first end of the handle portion and the second end of the generally flexible member is attached to a second end of the handle portion, the handle portion and generally flexible member cooperating to form a loop;

a strap disposed about the generally flexible member for attaching the flexible member of the functional power grip to a piece of exercise equipment; and a pair of crimps, each crimp being swaged to one of the first and second ends of the generally flexible member, and wherein the crimps are fitted into and attached to the generally elongate handle portion by a coupler that passes transversely through the handle portion, at least one of the crimps, and the generally flexible member.

2. The functional power grip of claim 1, wherein the generally flexible member is a rope, and wherein the generally elongate handle portion is a tubular member.

3. The functional power grip of claim 2, wherein the crimps are press-fit into the handle portion.

4. The functional power grip of claim 1, wherein the handle portion includes a generally tubular member having a flange at each end.

5. The functional power grip of claim 1, wherein the coupler strap includes a webbing that forms a first loop about the generally flexible member and a second loop that is formed over a metallic ring.

6. The functional power grip of claim 1, wherein each of the pair of crimps comprises a hole configured for the passage of the coupler therethrough.

7. The functional power grip of claim 1, wherein the generally elongate handle portion comprises a hole configured for the passage of the coupler therethrough.

8. The functional power grip of claim 1, wherein the coupler comprises a screw and internally threaded tube.

* * * * *